US005167698A

United States Patent [19]

Miyagawa et al.

[11] Patent Number: 5,167,698

[45] Date of Patent: Dec. 1, 1992

[54] VACUUM-SUCTION DEGASSING METHOD AND AN APPARATUS THEREFOR

[76] Inventors: Nobuo Miyagawa, 9-45-2, Sakaue-cho, Tajimi-shi, Gifu-ken; Kunji Yamamoto, 10-2-127, Asahigaoka, Tajimi-shi, Gifu-ken; Masamichi Sano, Fujimori 1-43-3, Meito-ku, Nagoya-shi, 465 Aichi-ken, all of Japan

[21] Appl. No.: 679,219

[22] Filed: Apr. 2, 1991

[30] Foreign Application Priority Data

Apr. 2, 1990 [JP] Japan ..... 2-87772

[51] Int. Cl.[5] ..... C21C 7/00

[52] U.S. Cl. ..... 75/405; 266/208

[58] Field of Search ..... 75/405; 266/208

[56] References Cited

U.S. PATENT DOCUMENTS 2,809,107 10/1957 Russell ..... 75/405

*Primary Examiner*—Peter D. Rosenberg

*Attorney, Agent, or Firm*—Oblon, Spivak, McClelland, Maier & Neustadt

[57] ABSTRACT

Part of a melt vessel is formed from a porous member which is permeable to gas and impermeable to melts. Alternatively, a bottomed cylindrical partitioning member immersed in a melt in the melt vessel, or part of a circulating vessel through which the melt circulates, or a dam disposed in the course of circulation of the melt in the melt circulating vessel is formed from the porous member.

Vacuum pump is used to suck gas from the melt or gas produced by a reaction at the interface between the melt and the porous member through the porous member, to the side of that surface of the porous member which is not in contact with the melt and kept at a vacuum or at reduced pressure.

Then, the pressure at the interface between the melt and the porous member is lowered, and a space which is in a vacuum or at reduced pressure can be easily created in the melt. Thus, solute ingredients of the melt nucleate easily to form gaseous substances, so that the gaseous substances are sucked into the space and removed from the melt.

6 Claims, 5 Drawing Sheets

VACUUM-SUCTION DEGASSING METHOD AND AN APPARATUS THEREFOR

BACKGROUND OF THE INVENTION

The present invention relates to a vacuum-suction degassing method and an apparatus therefor, in which gas-forming solute ingredients are removed or recovered from a melt, such as a molten metal, matte, or slag, through a porous member.

Conventionally, the RH method, DH method, and other degassing methods are used to remove gas-forming solute ingredients from a melt, such as a molten metal, matte, or slag. According to the RH or DH method, a large quantity of argon gas is blown into the melt, the surface of which is kept at a vacuum or at reduced pressure so that the partial pressure of the gas-forming ingredients is lowered, thereby removing these ingredients.

Requiring the use of argon gas in large quantity, however, the conventional RH or DH degassing method entails high running cost. Since much argon gas is blown into the melt, moreover, the melt is liable to splash so that many metal drops adhere to the wall surface or some other parts of the apparatus, which requires troublesome removal work. To cope with this splashing of the melt, furthermore, the apparatus is inevitably increased in size, resulting in higher equipment cost.

SUMMARY OF THE INVENTION

The object of the present invention is to provide a vacuum-suction degassing method and an apparatus therefor, in which gas-forming ingredients can be easily removed from a melt without using a large quantity of argon gas, so that the melt can be degassed at low cost by means of a simple apparatus.

A vacuum-suction degassing method according to the present invention comprises steps of dividing a melt from the outside by means of a porous member permeable to gas and impermeable to melts, and removing gas-forming ingredients from the melt by keeping the outside region at a vacuum or at reduced pressure.

In a vacuum-suction degassing apparatus according to the present invention, (1) part of a melt vessel, (2) a bottomed cylindrical partitioning member immersed in a melt in the vessel, (3) part of a circulating vessel through which the melt circulates, or (4) a dam disposed in the course of circulation of the melt in the melt circulating vessel, are formed from a porous member which is permeable to gas and impermeable to melts.

Suction means is used to suck gas from the melt or gas produced by a reaction at the interface between the melt and the porous member through the porous member to the side of that surface of the porous member which is not in contact with the melt and kept at a vacuum or at reduced pressure.

Thus, according to the present invention, the melt is divided from the outside by means of the porous member which is permeable to gas and impermeable to melts, and the pressure at the interface between the melt and the porous member is lowered by keeping the outside region at a vacuum or at reduced pressure. In this arrangement, a space which is in a vacuum or at reduced pressure can be easily created in the melt, and solute ingredients of the melt nucleate easily to form gaseous substances, so that the gaseous substances are sucked into the space and removed from the melt.

In the apparatus of the present invention, moreover, the surface area of the porous member to come into contact with the melt can be increased as required, so that the concentration of the solute ingredients in the melt can be lowered to a very low level.

According to the present invention, in contrast with the conventional degassing methods in which a large quantity of argon gas is blown in, gas is not blown in or only a small quantity of argon gas, if any, is expected to be blown in for stirring the melt, so that the unit of use of argon gas can be considerably reduced. Since very little argon gas is used, moreover, splashing of the melt can be restrained, so that the metal drops adhering to the wall surface of the apparatus can be reduced and the load of the vacuum pump is reduced. Thus, according to the present invention, the equipment cost and running cost can be reduced to a marked degree.

DETAILED DESCRIPTION OF THE PREFERRED EMBODIMENTS

Figure 1:
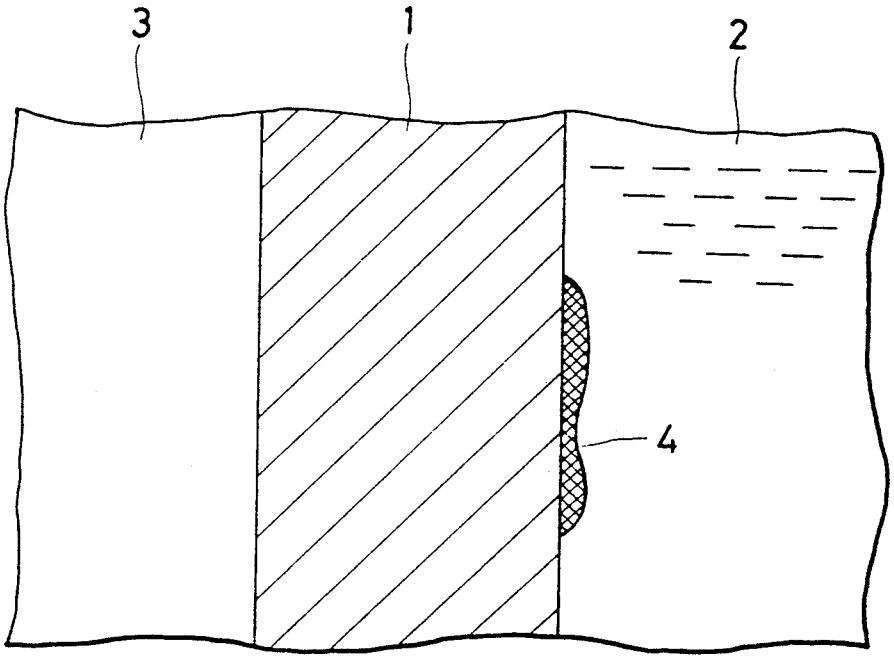
FIG. 1 is a diagram for illustrating the principle of the present invention.

FIG. 1 is a diagram illustrating the principle of the present invention. Porous member 1 is formed of a porous material which is permeable to gas only, that is, impermeable to melts, such as a molten metal, matte, and slag. If melt 2 is brought into contact with one side of porous member 1, and if the other side of member 1 is kept at a vacuum or at reduced pressure 3, the pressure on the wall surface in contact with the melt drops without regard to the static pressure of the melt.

Accordingly, those impurities or valuables in melt 2 which produce gaseous substances easily nucleate on the wall surface of porous member 1 to form gas 4, and resulting gas 4 permeates through member 1 and sucked into the vacuum or decompressed atmosphere 3 so that the impurities or valuables are removed from the melt and recovered in the vacuum or decompressed atmosphere 3.

The inventor hereof realized that gas-forming ingredients can be removed from the melt on the basis of the principle described above, and brought the present invention to completion.

The gas-forming ingredients dissolved in the melt are sucked and removed in the form of gases as follows:

$$\underline{N}+\underline{N}=N_2 \quad (1)$$

$$\underline{H}+\underline{H}=H_2 \quad (2)$$

$$\underline{C}+\underline{O}=CO \quad (3)$$

$$\underline{S}+2\underline{O}=SO_2 \quad (4).$$

The impurities in the melt may react with the ingredients of the porous member, to form gases, and then they may be removed through the porous member.

If the porous member is an oxide ($M_XO_Y$), carbon in the melt is removed in the form of a gas as follows:

$$y\underline{C}+M_XO_Y(\text{solid})=x\underline{M}+yCO \quad (5).$$

If the porous member contains carbon, moreover, oxygen in the melt is sucked and removed according to the following reaction formula.

$$\underline{O}+C(\text{solid})=CO \quad (6).$$

The separative recovery of a valuable component (M) which has high vapor pressure is achieved by gasifying the valuable component according to the following reaction formulas.

$$x\underline{M}=M_X(\text{gas}) \quad (7)$$

$$MO_Y=MO_Y(\text{gas}) \quad (8)$$

$$MS_Y=MS_Y(\text{gas}) \quad (9).$$

In this manner, the impurities, such as N, H, O, and S, and the valuable components are sucked and removed or recovered from the melt.

The following is a description of a case in which the present invention is applied to the removal or recovery of gas-forming ingredients from a melt.

(1) First, the present invention can be applied to decarburization, denitrogenation, and dehydrogenation processes for removing carbon, nitrogen, or hydrogen from molten iron.

(2) The invention can be also applied to a deoxygenation process for removing oxygen from molten copper.

(3) Further, the invention can be applied to a dehydrogenation process for removing hydrogen from molten aluminum.

(4) Furthermore, the invention can be applied to decarburization, and dehydrogenation of molten silicon.

(5) According to the present invention, zinc can be recovered from molten lead.

(6) The invention can be also applied to a desulfurization/deoxygenation process for removing sulfur and oxygen from molten copper matte.

(7) Further, the invention can be applied to the recovery of valuable metals (As, Sb, Bi, Se, Te, Pb, Cd, etc.) from molten copper matte or nickel matte.

(8) Furthermore, the invention can be applied to the recovery of valuable metals (As, Sb, Bi, Se, Te, Pb, Cd, Zn, etc.) from slag.

Various materials may be used for porous member 1, including metal oxides or other metallic compounds (non-oxides) and mixtures thereof and metal, such as $Al_2O_3$, MgO, CaO, $SiO_2$, FeO, $Cr_2O_3$, BN, $Si_3N_4$, etc. Preferably, the material used should not react with the principal ingredient of melt 2 so that porous member 1 in contact with melt 2 can be prevented from erosion loss and melt 2 can be kept clean.

In order to make porous member 1 permeable to gas only and impermeable to melts, its porosity is preferably restricted to 40% or less, and its diameter is preferably about 200 μm or less. The porosity and pore diameter are controlled according to the wettability of the porous member 1.

Preferred embodiments of the present invention will now be described in detail with reference to the accompanying drawings, in which like reference numerals designate like or corresponding parts throughout the several views.

Figure 2:
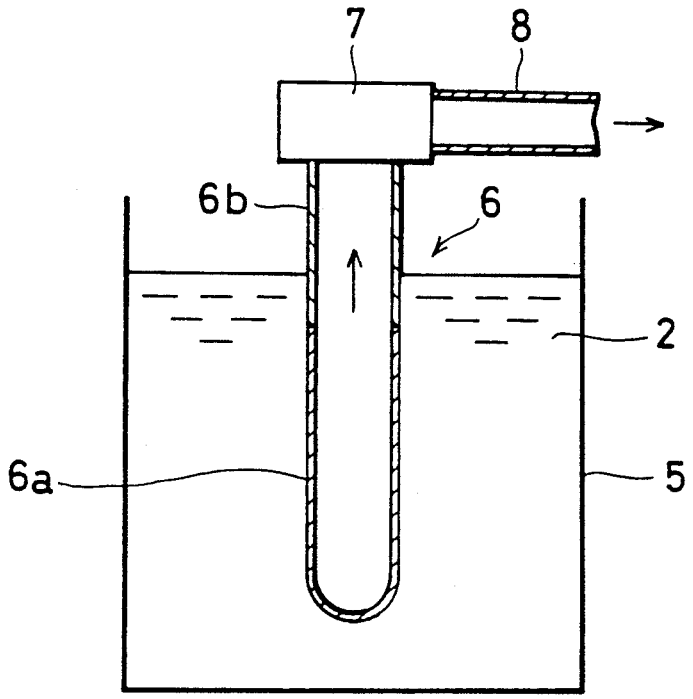
FIG. 2 is a vertical sectional view showing a first embodiment of the invention.

FIG. 2 is a schematic sectional view showing a first embodiment of the invention. This embodiment is a batch-type vacuum degassing apparatus. Melt 2 is stored in vessel 5, and the lower half of degassing member 6 is immersed in melt 2. Degassing member 6 is in the form of a cylinder closed at the bottom, and its lower half immersed in melt 2 is formed of porous member **6*a*. Member 6*a* is formed of a porous material which, having fine pores, is permeable to gas, but is impermeable to melts, such as a molten metal, slag, and matte. The upper half of degassing member 6 is formed of nonporous member 6*b* which is impermeable to gas. Porous and nonporous members 6*a* and 6*b* may be joined together after being separately prepared. Alternatively, that portion of degassing member 6 which is to form ononporous member 6*b*** may be made impermeable to gas by, for example, being coated with a gas-impermeable nonporous material, after the whole degassing member is formed from a porous material.

A connecting member 7 is fixed to the upper end portion of gas-impermeable nonporous member **6*b* which is exposed to an atmosphere. Also, pipe 8, which is connected to a suitable vacuum-suction pump (not shown), is coupled to connecting member 7 so as to communicate with degassing member 6**.

In the vacuum-suction degassing apparatus constructed in this manner, when the inside of degassing member 6 is evacuated or decompressed by suction through pipe 8, the gas-forming ingredients are removed from melt 2 by being discharged into degassing member 6 through porous member **6*a*** thereof.

Figure 3:
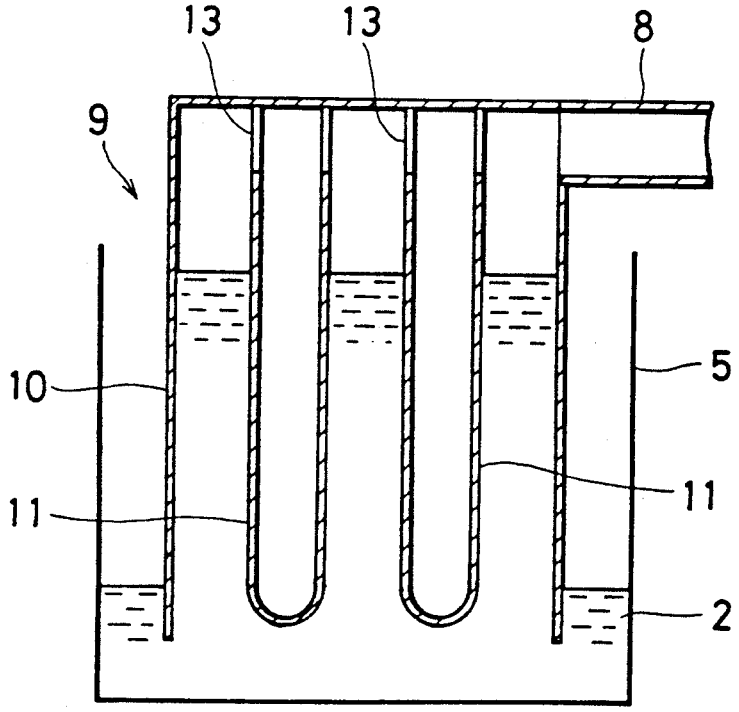
FIG. 3 is a vertical sectional view showing a second embodiment of the invention.

Referring now to FIG. 3, a second embodiment of the present invention will be described.

Degassing member 9 comprises cylindrical housing 10, having a top wall, and bottomed cylindrical porous members 11 therein. Housing 10, which is open at the bottom end, is set so that its bottom opening portion is immersed in melt 2. Pipe 8 is connected to the top end of housing 10. The inside of housing 10 is evacuated or decompressed by suction through pipe 8 by means of a suitable vacuum pump (not shown).

A plurality of porous members 11 are suspended from the top wall of housing 10. Members 11 are formed entirely of a porous material which is permeable to gas but is impermeable to melts. Hole 13 through which the gas passes is formed at the upper end portion of each porous member 11.

In the vacuum degassing apparatus constructed in this manner, when housing 10 is exhausted by suction through pipe 8, a vacuum is formed in the housing, so that melt 2 in vessel 5 rises in the housing, and its surface reaches a position matching its static pressure.

Accordingly, the substantially whole surface of each porous member 11 is brought into contact with melt 2. Then, the gas-forming ingredients in melt 2 are sucked and removed in the form of gases from the melt through porous member 11. In the present embodiment, melt 2 touches a very wide region of each porous member 11, so that the gas-forming ingredients can be removed from the melt with very high efficiency.

Figure 4:
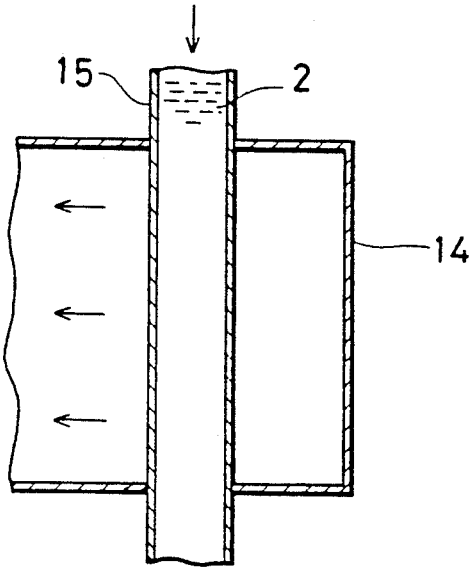
FIG. 4 is a vertical sectional view showing a third embodiment of the invention.

Referring now to FIG. 4, a vacuum degassing apparatus according to a third embodiment of the present invention will be described. This embodiment is a continuous vacuum degassing apparatus. Cylindrical melt circulating pipe 15 penetrates a vacuum vessel 14. The inside of vessel 14, which is connected to a suitable vacuum pump (not shown), is kept at a vacuum. At least that part of circulating pipe 15 which is situated in vessel 14 is formed of a porous member which has the aforementioned properties. Melt 2 is allowed to circulate through pipe 15.

In the vacuum degassing apparatus constructed in this manner, that portion of melt 2 which is in contact with circulating pipe 15 is exposed to the vacuum through the porous circulating pipe when the melt circulates through pipe 15 and flows in vacuum vessel 14. While melt 2 is flowing in vessel 14, therefore, its gas-forming ingredients are sucked and removed. Thus, the gas-forming ingredients can be continuously removed from melt 2.

Figure 5A:
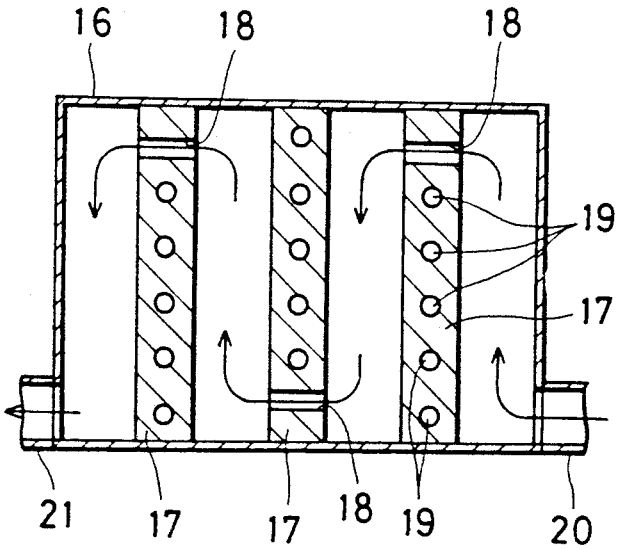
FIGS. 5A and 5B are a plan view and a vertical sectional view, respectively, showing a fourth embodiment of the invention.
Figure 5B:
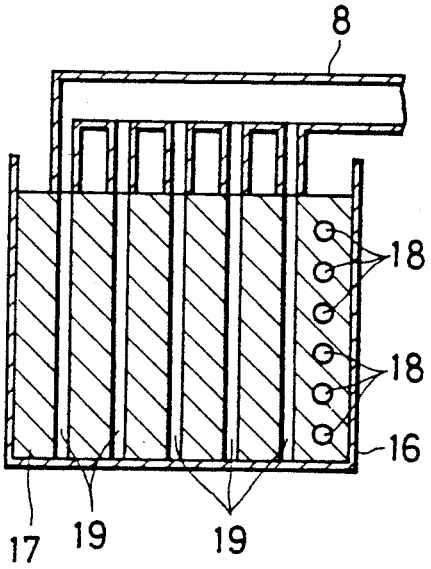

Referring now to FIG. 5, a fourth embodiment of the present invention will be described. FIG. 5A is a plan view showing a vacuum degassing apparatus according to this fourth embodiment, and FIG. 5B is a vertical sectional view of the apparatus. A plurality of planar dams 17 (three in number according to the example illustrated) are arranged parallel to one another at suitable intervals in open-topped box-shaped vessel 16. A plurality of melt passage holes 18 are bored through one end portion of each dam 17 in the thickness direction thereof, so as to be arranged in the height direction of dam 17. Also, a plurality of gas suction holes 19 (five in number according to the example illustrated) are bored through each dam 17 in the height direction thereof, so as to be arranged in the width direction of dam 17. Further, vessel 16 has inlet 20 and outlet 21 for melt 2. Dams are formed of a porous member having the aforementioned properties.

In the vacuum degassing apparatus constructed in this manner, melt 2 enters vessel 16 via inlet 20, and its course of circulation is regulated by means of dams 17. Melt 2 passes through melt passage holes 18 of dams 17 and circulates in zigzags in vessel 16, as indicated by arrows in the plan view of FIG. 5A. Meanwhile, gas suction holes 19 of dams 17 are kept in a vacuum by suction through pipe 8, so that melt 2 is exposed to the vacuum through dams 17 while it is circulating through its course regulated by the dams. Thus, gas-forming ingredients are sucked and removed from melt 2.

Also in this embodiment, melt 2 can be continuously degassed, and the area of the porous member which touches the melt is wider than in the case of the embodiment shown in FIG. 4. Accordingly, the gas-forming ingredients can be removed from melt 2 with higher efficiency.

Figure 6:
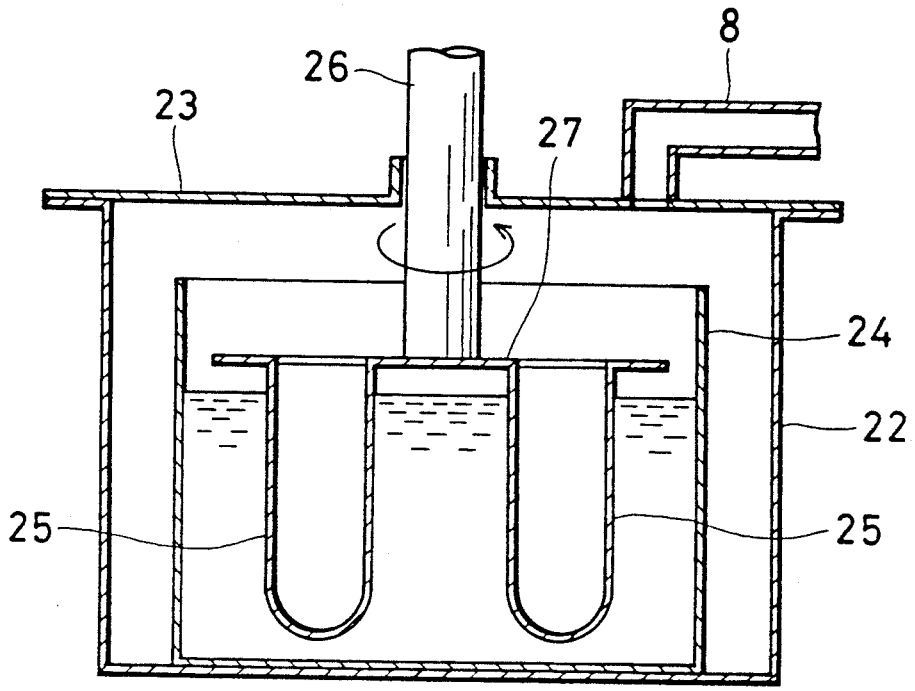
FIG. 6 is a vertical sectional view showing a fifth embodiment of the invention.

FIG. 6 is a vertical sectional view showing a vacuum degassing apparatus according to a fifth embodiment of the invention. Vacuum vessel 22 is hermetically sealed by means of lid 23. Pipe 8 is connected to lid 23, and the inside of vacuum vessel 22 is kept at a vacuum by suction through pipe 8 by means of a suitable vacuum pump (not shown). Melt vessel 24 is disposed in vacuum vessel 22, and melt 2 is stored in vessel 24. A plurality of bottomed cylindrical porous members 25 are suspended from horizontal supporting plate 27. Supporting shaft 26 is fixed to the center of plate 27 so as to extend vertically to the outside through lid 23. Shaft 26 is rotated by means of a motor (not shown) which is located outside vacuum vessel 22. As shaft 26 rotates in this manner, porous members 25 move around shaft 26.

In the vacuum degassing apparatus constructed in this manner, melt 2 is loaded into melt vessel 24, porous member 25 is immersed in melt 2, and lid 23 is put on vacuum vessel 22. Thereafter, vessel 22 is evacuated through pipe 8. Then, member 25 is rotated by means of supporting shaft 26. Thereupon, melt 2 is exposed to the vacuum through porous member 25, and is stirred as member 25 rotates. Accordingly, melt 2 in vessel 24 is uniformly exposed to the vacuum, so that the gas-forming ingredients of melt 2 uniformly gasify on the surface of porous member 25, or uniformly react with member 25, thereby producing gases as reaction products. These gases are sucked and removed from melt 2 through porous member. Thus, according to the present embodiment, degassing can be effected with very high efficiency.

The following is a description of results of decarburization of molten iron. This decarburization test was conducted by using the apparatus shown in FIG. 2. First, 400 g of electrolytic iron was melted by means of a high-frequency induction furnace, and was loaded into an alumina crucible (inside diameter: 40 mm). Then, a porous alumina pipe ($Al_2O_3$: 93%, $SiO_2$: 6.5%, $Fe_2O_3$: 0.5%, outside diameter: 14 mm, inside diameter: 6 mm, porosity: 25%) was immersed to a depth of 40 mm in molten iron 46 mm deep in the crucible. The internal pressure of this porous pipe was reduced to 2 torr.

Thereafter, carbon was added to the molten iron so that the carbon concentration of the molten iron was 100 ppm. As a result, the carbon concentration of the molten iron was lowered from 100 ppm to 10 ppm in 20 minutes after the addition of carbon. In the meantime, the oxygen concentration was kept constant at about 50 ppm. It is evident, therefore, that the degassing advances as carbon reacts with alumina and the like in the material of the porous pipe according to the following reaction formulas.

$$3\underline{C}+Al_2O_3=2\underline{Al}+3CO,$$

$$2\underline{C}+SiO_2=\underline{Si}+2CO,$$

$$3\underline{C}+Fe_2O_3=2Fe+3CO.$$

In this manner, CO gas is removed from the molten iron, while Al and Si are added to the molten iron.

Figure 7:
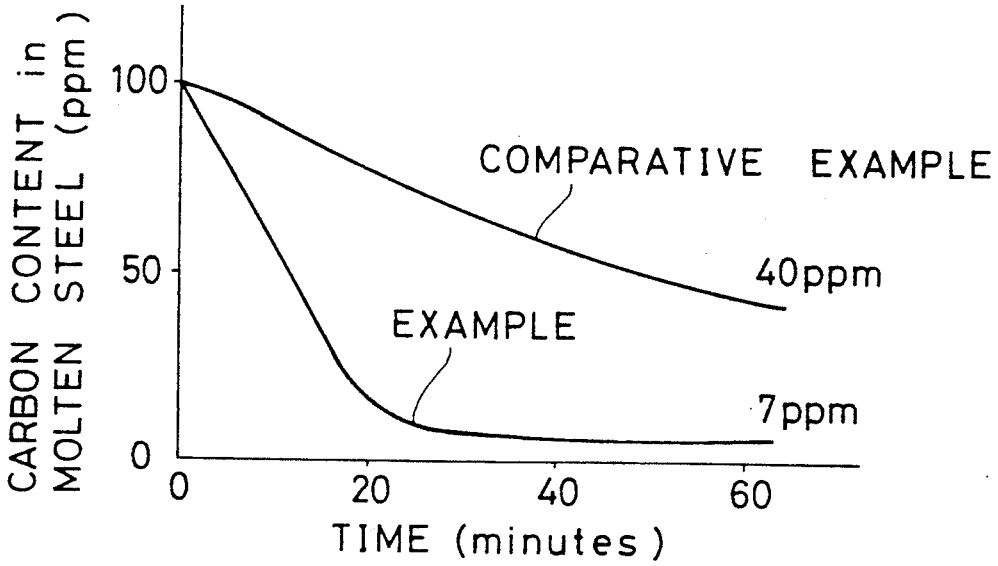
FIG. 7 is a graph showing the effect of the invention.

The following is a description of the decarburization efficiency for the aforementioned embodiment in which the internally decompressed porous alumina pipe was immersed, compared with that for a comparative example in which no porous pipe was used. FIG. 7 is a graph comparatively showing the efficiencies for the respective cases of the embodiment using the porous pipe and the comparative example using no porous pipe. In FIG. 7, the axes of abscissa and ordinate represent the time and the carbon concentration of the molten iron. As seen from FIG. 7, the carbon concentration lowered to 7 ppm in about 25 minutes of vacuum suction degassing with use of the porous pipe, while the concentration lowered only to 40 ppm even after one hour of degassing without the use of the porous pipe. Thus, the present invention can be very effectively applied to the removal or recovery of gas-forming solute ingredients from melts.

The following is a description of the influence of the gas permeability of the porous member to the degassing rate. Generally, the following conditions are required as essential ones in degasification of a molten material for its purification:

1) low partial pressure of gas component on the reaction interface, and
2) rapid removal of generated gas.

In the locally depressurized dissolution method, however, as a non-porous mullite porcelain pipe is used, the above conditions are not satisfied. For this reason, a degassing rate in the locally depressurized dissolution method is slower than that in the vacuum suction degassing method, and it is difficult to make purity of a molten material extremely high.

Figure 8:
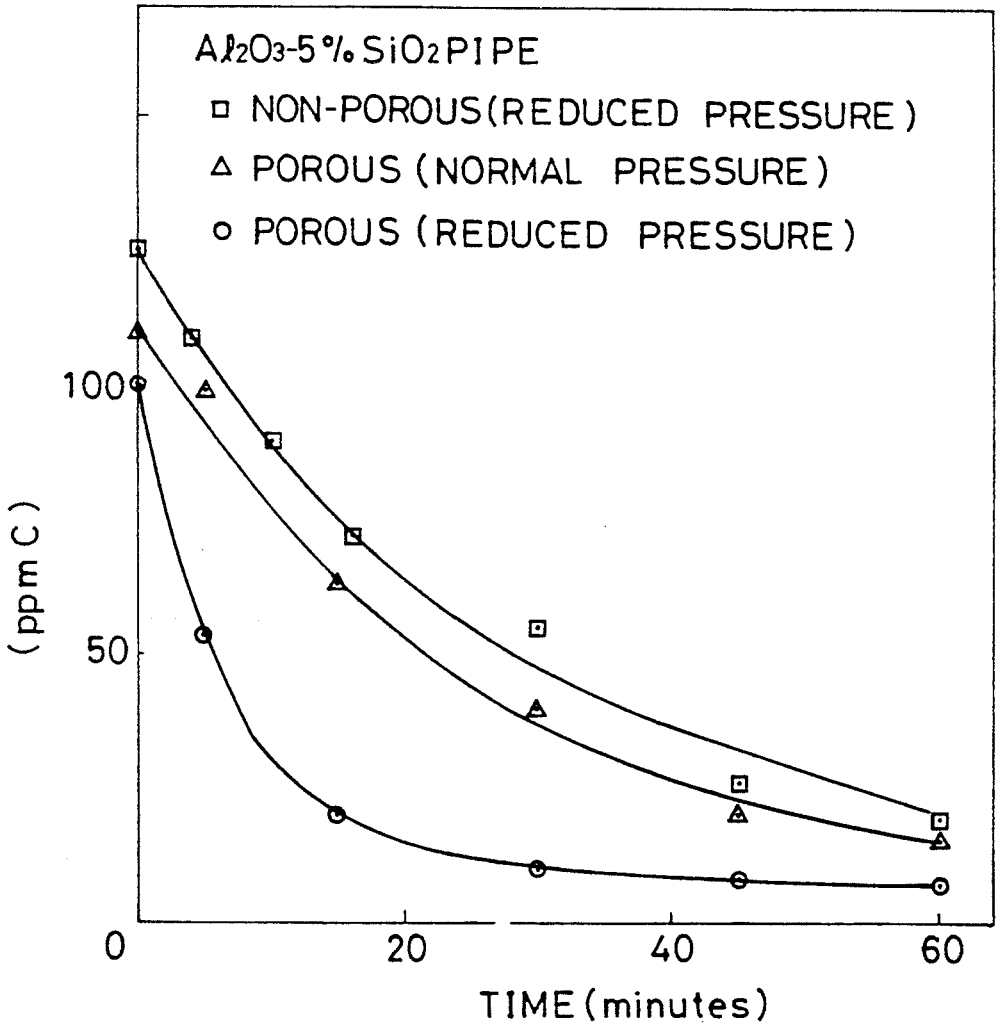
FIG. 8 is a graph showing the relationship between the carbon content and the time.

A comparison between a case where non-porous porcelain pipe is used and a case where a porous pipe is used, both for decarburization of molten iron, is shown in FIG. 8. Also, a case, where a porous pipe is immersed with normal pressure in it, is shown for comparison. This graph shows that a decarburizing rate in a case where a non-porous porcelain pipe is used is almost the same as that in a case where a porous pipe is used with the inside of the pipe kept at normal pressure, which suggests that pressure reduction in a non-porous pipe gives almost no effect, and that, when pressure is reduced in a porous pipe, the decarburizing rate is largely increases. Note that the conditions for the testing, excluding composition of the immersion pipe, are the same as those in the previous experiment (see FIG. 7).

A reaction rate constant on a surface of an immersion pipe can be obtained through the following equation.

$$\ln \frac{[\text{ppm C}]_0}{[\text{ppm C}]} = k_c \frac{A_c}{V} t + \frac{A_t}{V} t$$

wherein, [ppm C] is the carbon content in the molten iron, k is the reaction rate constant. A is the area of the reaction interface, V is the volume of the molten iron, t is time, $[\text{ppm C}]_0$ indicates the initial carbon content, and subscripts C and t indicate the interface between the crucible and molten iron and the interface between the immersion pipe and molted iron, respectively.

We analyzed results of the experiments using the above equation, and obtained the following results.

Dense (with pressure in the pipe reduced)

$k_t = 0.00063$ cm/s.

Porous (with pressure in the pipe kept normal)

$k_t = 0.00064$ cm/s.

Porous (with pressure in the pipe reduced)

$k_t = 0.00421$ cm/s.

These results indicate that, if the pressure in a pipe is reduced, a reaction rate constant for a porous pipe is about 6.7 times larger than that for a non-porous pipe.

In the locally depressurized dissolution method, a mullite ($Al_2O_3$:$SiO_2$) is used to remove H in molten Al. As mullite easily reacts and gets wet with Al, Al easily comes into minute holes, so that there is no way for use, but to use a non-porous porcelain pipe. On the other hand, in the vacuum suction degassing method, a porous pipe is used to make use of the fact, when a material which hardly gets wet with molten material is used, the molten material does not come into minute holes, which is a feature of this method. For this reason, a mechanism to remove generated gas in the locally depressurized dissolution method is based on diffusion because the pipe is non-porous, while a mechanism in the vacuum suction degassing method is based on vacuum suction, so the mechanism in these two methods are completely different.

Furthermore, also a fact that, in the vacuum suction degassing method, gas is generated and removed by making component in a molten material react with those of a porous pipe is one of the features of this method, and can be regarded as an important difference from the locally depressurized dissolution method.

What is claimed is:

1. A vacuum-suction degassing method comprising steps of:
   - dividing a melt from the outside by means of a porous member permeable to gas and impermeable to melts; and
   - removing gas-forming ingredients from said melt by keeping the outside region at a vacuum or at reduced pressure.
2. A vacuum-suction degassing apparatus comprising:
   - a melt vessel formed partially of a porous member permeable to gas and impermeable to melts; and
   - suction means for sucking gas from a melt or gas produced by a reaction between said melt and said porous member through said porous member, at a vacuum or at reduced pressure.
3. A vacuum-suction degassing apparatus comprising:
   - a vessel containing a melt;
   - a bottomed cylindrical partitioning member formed of a porous member permeable to gas and impermeable to melts, said partitioning member being immersed in said melt; and
   - suction means for sucking gas from said melt or gas produced by a reaction between said melt and said porous member through said porous member, in a manner such that the inside of said partitioning member is kept at a vacuum or at reduced pressure.
4. A vacuum-suction degassing apparatus comprising:
   - a circulating vessel through which a melt circulates;
   - a porous member permeable to gas and impermeable to melts, said porous member constituting part of said circulating vessel; and
   - suction means for sucking gas from said melt or gas produced by a reaction between said melt and said porous member through said porous member, in a manner such that a region outside said porous member is kept at a vacuum or at reduced pressure.
5. A vacuum-suction degassing apparatus comprising:
   - a circulating vessel through which a melt circulates;
   - a porous member permeable to gas and impermeable to melts, said porous member being disposed in the course of circulation of said melt to constitute a dam; and
   - suction means for sucking gas from said melt or gas produced by a reaction between said melt and said porous member through said porous member, in a manner such that a passage in said porous member is kept at a vacuum or at reduced pressure.
6. A vacuum-suction degassing method comprising steps of;
   - dividing a melt from the outside by means of a porous member which is permeable to gas and impermeable to melts and is able to react with gas-forming ingredients in the melt; and
   - removing gas which is produced by the reaction between the porous member and the ingredients in the melt by keeping the outside region at a vacuum or at reduced pressure.

* * * * *

UNITED STATES PATENT AND TRADEMARK OFFICE

CERTIFICATE OF CORRECTION

PATENT NO. : 5,167,698

DATED : December 1, 1992

INVENTOR(S) : Nobuo Miyagawa, et. al.

It is certified that error appears in the above-indentified patent and that said Letters Patent is hereby corrected as shown below:

On the Title page, item [73], Assignee: should be TOKYO YOGYO KABUSHIKI KAISHA, TOKYO, JAPAN--(part interest).

Signed and Sealed this

Ninth Day of November, 1993

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,167,698

DATED : December 1, 1992

INVENTOR(S) : NOBUO MIYAGAWA

It is certified that error appears in the above-identified patent and that said Letters Patent is hereby corrected as shown below:

In column 4, line 23, change "ononporous" to --nonporous--.

In column 7, line 27, change "increases" to --increased--;

line 32, change $$\text{"} \ln \frac{[\text{ppm C}]_0}{[\text{ppm C}]} = k_c \frac{A_c}{V} t + \frac{A_t}{V} t \text{"}$$

to $$\text{--} \ln \frac{[\text{ppm C}]_0}{[\text{ppm C}]} = k_c \frac{A_c}{V} t + k_t \frac{A_t}{V} t \text{--;}$$

line 40, change "subscripts C" to --subscripts c--.

Signed and Sealed this

Eighteenth Day of January, 1994

*Attest:*

*Attesting Officer*

BRUCE LEHMAN

*Commissioner of Patents and Trademarks*